United States Patent [19]

Johnson et al.

[11] Patent Number: 4,479,597

[45] Date of Patent: Oct. 30, 1984

[54] BURSTER FOR CONTINUOUS FORM STATIONERY

[75] Inventors: Marland R. Johnson, Harvey; Donald J. Nauheimer, Forest Park, both of Ill.

[73] Assignee: Uarco Incorporated, Barrington, Ill.

[21] Appl. No.: 466,814

[22] Filed: Feb. 16, 1983

[51] Int. Cl.[3] ..... B65H 35/10

[52] U.S. Cl. ..... 225/100; 225/4

[58] Field of Search ..... 225/100, 106, 4

[56] References Cited

U.S. PATENT DOCUMENTS 3,161,335 12/1964 Pine et al. .
3,331,543 7/1967 Kezeli ..... 225/100 X
3,338,487 8/1967 Schutz .
3,493,156 2/1972 Absler et al. .
3,672,551 6/1972 Peterson .
4,284,221 8/1981 Nagel et al. ..... 225/100

*Primary Examiner*—Frank T. Yost
*Attorney, Agent, or Firm*—Wood, Dalton, Phillips, Mason & Rowe

[57] ABSTRACT

A burster including spaced infeed and outfeed pairs of rollers in fixed spacial relationship with respect to each other which are driven by a system including a variable, limited lost motion connection to the infeed rollers. The connection includes a long-lived tooth and stop assembly wherein impacting surfaces of the tooth and the stop members are configured to minimize shear stresses occurring in the tangential direction in favor of readily absorbed radial stresses to thereby provide a long-lived apparatus.

10 Claims, 5 Drawing Figures

Fig. 3.
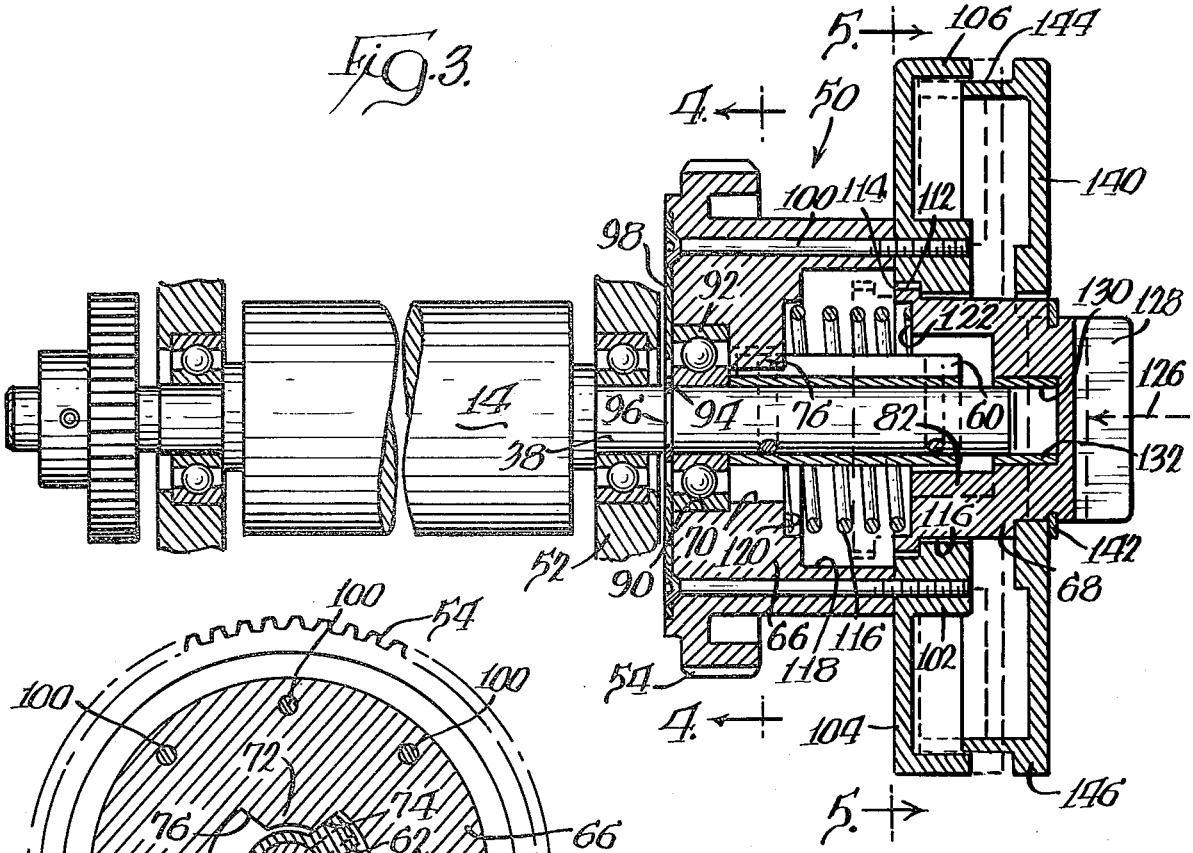
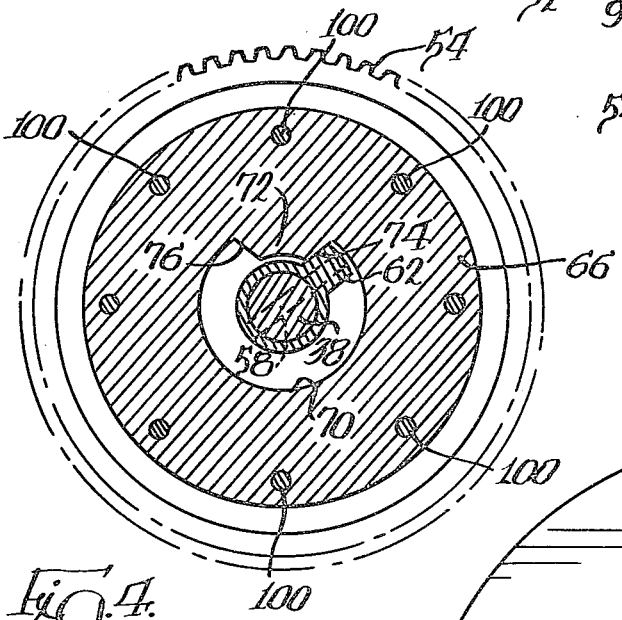
Fig. 4.
Fig. 5.
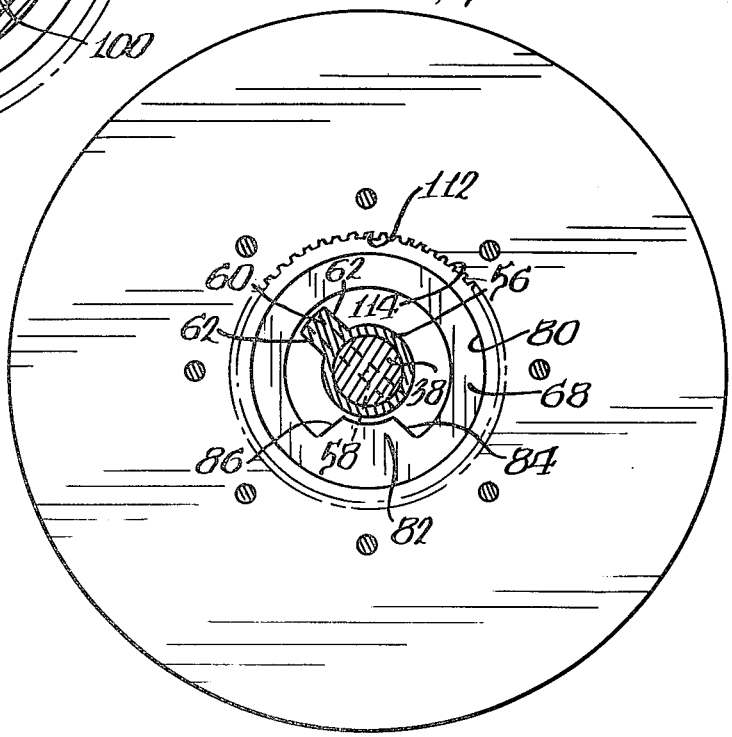

BURSTER FOR CONTINUOUS FORM STATIONERY

FIELD OF THE INVENTION

This invention relates to continuous business form stationery processing apparatus, and more specifically, to a burster for continuous business form stationery whereby such stationery may be separated into individual form lengths.

BACKGROUND ART

As is well known, bursters have long been employed in the processing of continuous business form stationery. In the usual case, such stationery includes one or more plies of substantial length which may be separated into individual business forms, i.e., individual form lengths, along transverse lines of perforation extending across the ply or plies.

Such separation can, of course, be accomplished manually but such is time consuming and defeats, at least in part, one of the main purposes of the use of continuous business form stationery, namely, rapid processing. Consequently, there have evolved various types of apparatus commonly known as bursters which separate a continuous business form into individual form lengths at rapid speeds.

Typical continuous business form stationery has varying form lengths depending upon the use to which the document is to be put. For example, when payroll checks in continuous form are being processed, each individual form length will be relatively short, typically on the order of 3 inches. Conversely, documents or letterheads employed in mass mailings or the like will have form lengths on the order of 11 inches, and occasionally lengths up to 14 inches.

Because one user of continuous business forms may be processing forms of varying form lengths in the course of his business, it is desirable that bursting apparatus be capable of properly bursting all business forms used, regardless of the form length.

A typical burster employs two pairs of rollers, an outfeed pair and an infeed pair. In the usual case, the outfeed pair of rollers is rotated at a higher angular velocity than the infeed pair. As soon as a form passes through the infeed pair of rollers and is engaged by the nip of the outfeed pair, because of the higher peripheral speed of the rollers of the outfeed pair, a tensioning force is placed on the business form which causes the same to separate along the transverse line of weakening.

It will be readily apparent, however, that before such can occur, there must be but a single one of a line of weakening between the two pairs of rollers. If no such line of weakening is present, tearing or wrinkling of the form will occur. If two such lines of weakening are located between the two sets of rollers, partial separation on each of the lines may occur or, there may be no separation whatsoever on one of the lines of weakening with the consequence that the form is improperly burst in either event.

Thus, in order to compensate for varying form lengths, burster manufacturers have heretofore generally provided an adjustment in the apparatus whereby the spacing between the infeed pair of rollers and the outfeed pair of rollers may be selectively varied dependent upon the form length of the continuous business form to be burst. This approach is exemplified in, for example, U.S. Pat. No. 3,161,335 issued Dec. 15, 1964 to Pine et al. and U.S. Pat. No. 3,493,156 issued Feb. 3, 1972 to Absler et al.

While these constructions work extremely well for their intended purpose, because of the need to adjust the spacing between the pair of rollers, the cabinets for housing the bursters necessarily must be larger than would be the case if a constant space of but a few inches could be employed.

One attempt at providing a fixed spacing burster is described in U.S. Pat. No. 3,338,487 issued Aug. 29, 1967 to Schutz. Schutz employs fixed spacing between two sets of burster rolls and drives the outfeed rolls at a higher angular velocity than the infeed rolls. A slip clutch is located in the drive for the outfeed rollers so that such rollers could rotate at a speed approximating that of the infeed rollers when no line of weakening was located between the two pairs of rollers in an attempt to avoid tearing or wrinkling of the form.

While the Schutz construction worked well in many instances, various deficiencies were present.

In an attempt to cure such deficiencies, there then evolved a structure as disclosed in U.S. Pat. No. 3,672,551 issued June 27, 1972 to Peterson. Peterson eliminated the slip clutch in the outfeed drive in favor of a limited, variable, lost motion connection in the infeed drive. By varying the length of the limited lost motion connection, as more fully described in the Peterson patent, the apparatus could be adjusted for business forms of a wide variety of different form lengths and yet was quite compact, having the desired fixed spacing between the infeed and outfeed roller pairs.

The Peterson invention worked extremely well over a large variety of business form lengths. However, when subjected to extended usage, because of the nature of the limited lost motion connection, there occasionally resulted a parts failure in that connection which in turn would require more frequent servicing than would be desired. In addition, the nature of the adjustment of the length of the limited lost motion connection was such as to require a fair degree of effort on the part of the operator of the machine to the extent that unskilled labor could not be employed to operate the same in every instance.

The present invention is directed to overcoming one or more of the above problems and constitutes an improvement on the apparatus described by Peterson.

SUMMARY OF THE INVENTION

It is the principal object of the invention to provide a new and improved burster for continuous business form stationery. More specifically, it is an object of the invention to provide a compact burster of the type having fixed, relatively short spacing between infeed and outfeed roller pairs and which is capable of bursting business forms having a wide variety of differing form lengths.

According to one facet of the invention, the burster comprises separated infeed and outfeed pairs of rollers spaced along a path of stationery travel. Means are provided for driving at least one roller in each pair and for driving an outfeed roller at a higher angular velocity than the infeed roller. Means are interposed between the driving means and the infeed roller establishing a variable but limited lost motion connection therebetween and includes a shaft defining a rotational axis and having a tooth. The tooth is generally radially extending, has opposed sides, each diverging from the radial on which the tooth is located as the axis is progressively approached. Each side of the tooth defines a contact face. The burster also includes first and second stop members, each having an aperture aligned with the axis such that the shaft extends therethrough. A radially directed stop is located on each stop member and extends into the associated aperture. Each stop has at least one stop face for abutment over a substantial area with one of the contact faces on the tooth and is arranged so as to be substantially parallel to the contact face when the two abut against each other. The stop face on each stop member converges on the radial on which the associated stop is located as the axis is approached.

According to another facet of the invention, there is provided a construction including pairs of rollers, driving means and limited lost motion connection means generally as stated above. A shaft defines a rotational axis and includes a tooth and first and second stop members are disposed about the shaft with each carrying a stop in the path of movement of the tooth. The stop members are relatively rotatable and axially movable with respect to each other. Means are provided for holding the stop members against relative rotation for one axial position of the stop members relative to each other and for allowing relative rotation of the stop members for another axial position of the stop members relative to each other. Spring means bias the stop members towards the first mentioned position and one of the stop members and the shaft is connected to the driving means with the other being connected to the infeed roller. Such a structure facilitates rapid and simple adjustment of the burster for forms having widely varying form lengths.

Other objects and advantages of the invention will become apparent from the following specification taken in connection with the accompanying drawings.

DESCRIPTION OF THE DRAWINGS

FIG. 3 is a view of the driven one of the infeed rollers illustrating a limited loss motion connection in section;

FIG. 4 is a sectional view taken approximately along the line 4—4 in FIG. 3; and FIG. 5 is a sectional view taken approximately along line 5—5 in FIG. 3.

DESCRIPTION OF THE PREFERRED EMBODIMENT

Figure 1:
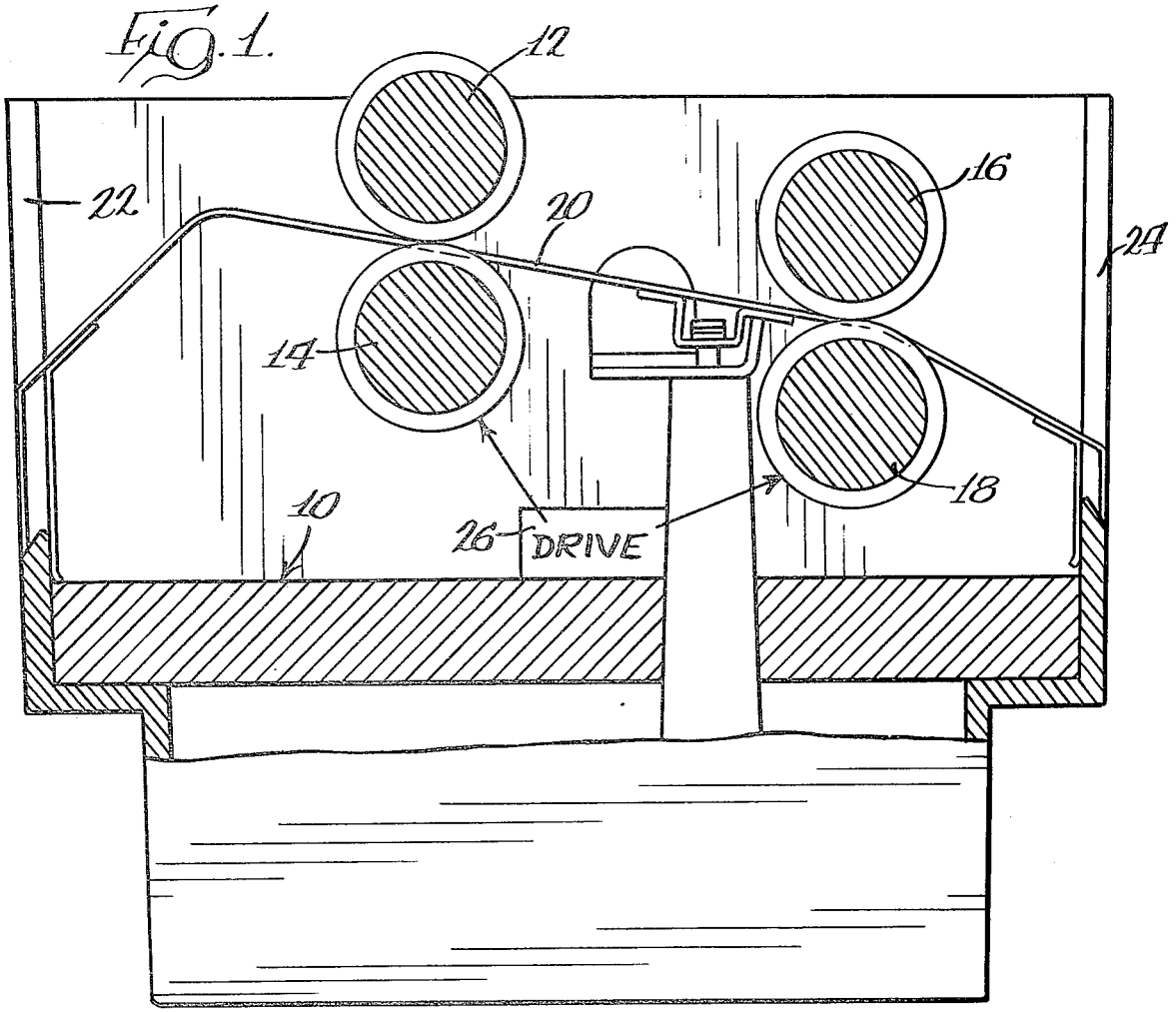
FIG. 1 is a somewhat schematic vertical section of a burster made according to the invention.

An exemplary embodiment of a burster made according to the invention is illustrated in the drawings and, for the most part, may take on the general form disclosed in the previously identified Peterson patent, the details of which are herein incorporated by reference. In the interest of brevity, it is noted that the essential components include a burster frame, generally designated 10, journaling two infeed rollers 12 and 14 and two outfeed rollers 16 and 18. A suitable paper guide 20 defines a path of stationery travel extending from an infeed end 22 of the burster to an outfeed end 24. The rollers 12–18 are, of course, located about the path of stationery travel defined by the paper guide 20.

In the preferred embodiment, the spacing between the infeed rollers 12 and 14 and the outfeed rollers 16 and 18 is fixed and a motor, shown schematically at 26, is operatively connected by a suitable drive such as a timing belt to at least one roller in each of the pairs. For example, the rollers 14 and 18 may be driven by the motor 26 and the rollers 12 and 16 geared respectively to the rollers 14 and 18 to be driven thereby.

Figure 2:
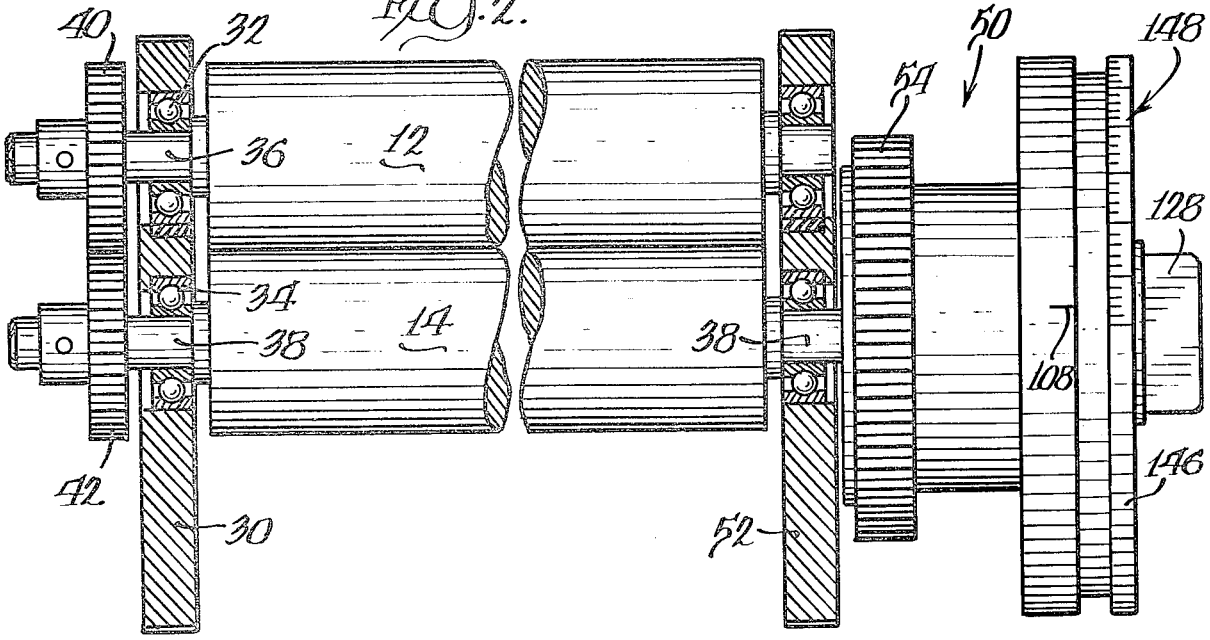
FIG. 2 is a front elevational view of the infeed roller pair with parts shown in section for clarity.

Such an arrangement is shown, for example, in FIG. 2 wherein a side member 30 of the frame 10 mounts bearings 32 and 34 which respectively journal shafts 36 and 38 extending from one end of each of the rollers 12 and 14. Spur gears 40 and 42 are respectively mounted on the shafts 36 and 38 to be enmeshed with each other so that upon rotation of the lower roller 14 by the motor 26, such rotation would be imparted to the roller 12 by the gears 40 and 42. As mentioned, a similar gearing arrangement (not shown) interconnects with the rollers 16 and 18.

The drive is such that rollers 16 and 18 of the outfeed pair have a higher peripheral velocity than the rollers 12 and 14 of the infeed pair. In a preferred embodiment, the ratio is 3:2, although other ratios can be used as desired.

As seen in FIGS. 2 and 3, a limited lost motion connection mechanism, generally designated 50, is connected to the drive shaft 38 for the lower infeed roller 14. This connection is made on the side of an upright frame member 52 opposite from the roller 14 itself and the mechanism 50 includes an external gear-like formation 54 about which a timing belt may be trained to connect the same to the drive motor 26.

The shaft 38 receives an elongated sleeve 56 which is pinned as by pins 58 to the shaft 38 for rotation therewith. The sleeve 56 further includes a radially outwardly directed tooth 60 having parallel sides 62 which act as contact faces for purposes to be seen. In the exemplary embodiment, the sides 62 are planar and it will be appreciated that the plane of each such side diverges from the radial extending from the axis of the shaft 38 on which the tooth 60 is located as the axis of the shaft 38 is approached.

In general, sleeve 56 and tooth 60 will be made of a metallic material such as steel for strength. The spacing between opposed faces 62, that is, the width of the tooth 60, is chosen to achieve a desired life in the mechanism. As will be seen, during operation, the tooth 60 is continually impacting against stops yet to be described. Such impacting ultimately may cause fatigue such that the tooth 60 fractures and separates from the remainder of the sleeve 56. Obviously, the thicker the tooth the longer it may withstand such impacting so the thickness is chosen to enable the burster to undergo a commercially acceptable number of impact cycles before failure.

The mechanism 50 further includes first and second stop members 66 and 68 respectively. Referring to FIG. 4, the stop member 66 is seen to include a central aperture 70. Extending into the aperture 70, generally radially thereof, is an integrally formed stop 72. The stop 72 has opposed stop faces or surfaces 74 and 76 which, in the exemplary embodiment, are both planar. The same are configured to be substantially parallel to the corresponding contact face 62 of the tooth 60 when in abutment therewith as shown, for example, in FIG. 4. Thus, it will be appreciated that the stop faces 74 and 76 are nonradial with respect to the axis of the shaft 38 and moreover converge on the radial on which the stop 72 is located as the axis of the shaft 38 is approached. As a consequence of this construction, when the tooth 62 impacts against one of the faces 74 or 76 of the stop 72, the force will be normal to the plane of the face 74 or 76 and because the same is nonradial, and has the relationship previously described with respect to the shaft axis, the resulting force has both radial and tangential components, the tangential component being reduced from that in the prior art structures. Because of the reduced tangential force applied to the stop 72, there is a lesser tendency for the tooth 72 to be sheared from the stop member 66 resulting in an extended life of the component.

FIG. 5 illustrates a stop 82 similar to the stop 72 carried by the stop member 66. Like the stop 72, the stop 82 has opposed stop faces 84 and 86 and the same are configured identically with respect to the tooth 60 as faces 74 and 76 to achieve the same advantages. Like the stop 72, the stop 82 is integrally formed on the stop member 68 and preferably both the stop member 66 and the stop member 68 are molded of impact resistant plastic. The use of plastic is preferred over metal for this component as it results in a reduced noise level during machine operation from that which would occur if both the tooth 60 and the stops 72 and 82 were of metal. Polyurethane is a preferred plastic because of its availability and price.

As alluded to earlier, the first stop member 66 carries the gear-like formation 54 about its periphery and, within the body of the stop member 66, to one side of the aperture 70, there is a stepped bore 90 receiving a bearing 92 by which the first stop member 66 is journaled on the shaft 38. A snap retainer 94 received in a groove 96 in the shaft 38 serves to limit axial motion of the loss motion mechanism 50 to the left on the shaft 38 as seen in FIG. 3 and such fastener 94 sandwiches the bearing 92 against the sleeve 56 to prevent rightward movement of the mechanism 50 on the shaft 38 as will be seen.

The left-hand side of the first stop member 66 includes an annular recess receiving a cap 98 which is apertured about the shaft 38 and the fastener 94 but which bears against the outer race of the bearing 92 to hold the same in the stepped bore 90.

The cap 98 is held in place by a series of flathead screws 100 which extend through bores in the first stop member 66 generally parallel to the shaft 38 to be received in threaded bores in the hub 102 of a shallow cup-like index element 104. The index element 104 includes a cylindrical, peripheral flange 106 which in turn is provided with an index mark 108 (FIG. 2).

The hub 102 of the index element 104 includes a central aperture 110 which slidably receives the second stop member 68 thereby mounting the same for both rotation and axial movement relative to the first stop member 66.

As seen in FIGS. 3 and 5, the left-hand edge of the bore 110 terminates in an enlarged, ring gear formation 112 and the left-hand end of the second stop member 68 is provided with a generally identical spur gear formation 114 which can mesh with the ring gear formation 112.

A compression coil spring 116 is disposed about the shaft 38 within a cavity 118 in the first stop member 66. One end of the coil spring 116 bears against a shoulder 120 formed on the first stop member 66 while the opposite end of the spring 116 bears against a similar shoulder 122 on the left-hand edge of the second stop member 68. Consequently, it will be appreciated that the spring 116 biases or urges the spur gear 114 on the second stop member 68 into engagement with the ring gear 112 carried by the first stop member 66 by reason of the mounting of the index element 104 thereon.

Consequently, when the components are in the solid line configuration illustrated in FIG. 3, relative rotational movement between the stop members 66 and 68 cannot occur by reason of the locking action between the gears 112 and 114. Conversely, when the first stop member 68 is pushed to the left by a manual force indicated by an arrow 126 to the dotted line position illustrated in FIG. 3, the second stop member 68 may be rotated with respect to the first stop member 66.

To facilitate such rotation, the right-hand end of the second stop member 68 is provided with an elongated handle 128 which may be gripped between the fingers of an operator of the machine for the purpose.

In order to assure continual positive alignment, the second stop member 68, just to the right of the aperture 80, is provided with a reduced diameter bore 130 which in turn receives a sleeve bearing 132 which, in turn, slidably receives the end of the shaft 38. Thus, during both reciprocal and rotary movement of the second stop member 68, the same is guided positively on the shaft 38.

The mechanism 50 is completed by a scale element 140 mounted on the second stop member 68 and carried therewith by a suitable spline (not shown) and lock ring 142. The scale 140 has a peripheral, cylindrical flange 144 sized to just fit within the flange 106 on the index element 104 as well as an annular, radially outwardly directed scale flange 146.

As seen in FIG. 2, a series of scale indicia, generally designated 148, are located about the periphery of the flange 146 and are so disposed thereon such that when a given designation is aligned with the index mark 108, the burster is set up to burst forms of the indicated form length.

INDUSTRIAL APPLICABILITY

Operation of the apparatus is as follows. The handle 128 of the mechanism 50 is grasped by the operator and axially shifted to the left as viewed in FIG. 3 until the gears 112 and 114 are unmeshed. At this time, the handle 128 is rotated to bring the desired scale character on the scale 148 into alignment with the index mark 108 on the index element 104. For example, if it is desired to burst forms having a form length of 11 inches, the designation 11 inches appearing on the scale 148 is aligned with the index mark 108. Business forms are then introduced into the nip of the infeed rollers 12 and 14 and the drive 26 energized.

At this point in time, assuming the configuration of components illustrated in the drawings, the stop face 74 of the stop 72 will be in abutment with one of the contact faces 62 of the tooth 60 as illustrated in FIG. 4 with the consequence that the shaft 38 will be driven thereby driving the lower infeed roller 14 as well as the gear 42.

In turn, the gear 40 will be driven by the gear 42 driving the infeed roller 12 to advance the form along the guides 20.

As soon as the form has advanced sufficiently down this path of stationery travel to engage the nip of the rollers 16 and 18, which, it will be recalled, are rotating at a peripheral speed approximately 50% faster than the rollers 12 and 14, the form will be accelerated to be tensioned and pulled through the rollers 12 and 14. However, since such rollers are not firmly fixed to the drive mechanism by reason of the presence of the limited lost motion connection mechanism 50, the shaft 38 will be accelerated to a higher speed causing the tooth 60 to loose contact with the stop 72 such that the rollers 12 and 14 assume an idler relationship with respect to the drive. This will continue until the opposite contact face 62 of the tooth 60 engages stop face 86 on the stop 82 of the second stop member 68 at which time a positive driving relationship is again established. This in effect brakes rollers 12 and 14 causing a sudden increase in tension on the form which in turn causes the form to separate at a line of perforation defining individual form lengths.

To adjust the burster for varying form lengths, it is only necessary to change the position of the stop 82 with respect to the stop 72 since the relative positions of those elements define the amount of lost motion in the drive for the rollers 12 and 14. The arrangement is such that the longer the form length, the greater the amount of lost motion in the connection that is desired.

As can be readily appreciated, for each form length burst, there is an impact against each of the stop members 72 and 82. Each such impact tends to cause shear of the associated stop thereby encouraging machine failure. However, when the surfaces 62, 74, 76, 84 and 86 are configured in the manner mentioned previously, deleterious shear forces are reduced by transmitting much of the force radially with the consequence that a long-lived machine results.

It will also be appreciated that a burster made according to the invention provides ease of operation by relatively unskilled personnel in that the adjustment process for varying form lengths is easily effected simply by manipulation of the single handle 128.

We claim:

1. A burster comprising separated infeed and outfeed pairs of rollers spaced along a path of stationery travel, means for driving at least one roller in each pair and for driving an outfeed roller(s) at a higher angular velocity than the infeed roller(s), and means interposed between said driving means and said infeed roller(s) establishing a variable, limited lost motion connection therebetween, and including (a) a shaft defining a rotational axis and having a tooth, (b) first and second stop members disposed about said shaft and each carrying a stop in the path of movement of the tooth on said shaft, said stop members being relatively rotatable and axially movable with respect to each other, (c) means for holding said stop members against relative rotation for one axial position of said stop members relative to each other and for allowing relative rotation of said stop members for another axial position of said stop members relative to each other, and (d) spring means biasing said stop members toward said one position, (e) one of said shaft and said stop members being connected to said driving means and the other of said shaft and said stop members being connected to said infeed roller(s).

2. The burster of claim 1 wherein each of said stops has at least one stop surface adapted to be engaged by said tooth over a substantial area, each said surface being spaced from, and nonradial to said rotational axis.

3. The burster of claim 2 wherein said tooth extends radially from said shaft and has opposed, nonradial sides adapted to make face contact with said stop surfaces.

4. The burster of claim 2 wherein said stops are formed of plastic.

5. A burster comprising separated infeed and outfeed pairs of rollers spaced along a path of stationery travel, means for driving at least one roller in each pair and for driving an outfeed roller(s) at a higher angular velocity than the infeed roller(s), and means interposed between said driving means and said infeed roller(s) establishing a variable, limited lost motion connection therebetween, and including (a) a shaft having a rotational axis and mounting a generally radially extending tooth, said tooth having opposed sides, each diverging from the radial on which said tooth is located as said axis is progressively approached, each said side defining a contact face;

(b) first and second stop members, each having an aperture aligned with said axis with said shaft extending therethrough, (c) a radially directed stop on each said stop member and extending into the associated aperture, each said stop having at least one stop face for abutment over a substantial area with one of said contact faces and being arranged so as to be substantially parallel to said contact face during said abutment, said stop faces converging on the radial on which the associated stop is located as said axis is approached.

6. The burster of claim 5 wherein said stop members are axially movable with respect to each other and further are not relatively rotatable for one position of relative axial movement and relatively rotatable for another position of relative axial movement.

7. The burster of claim 5 wherein said sides are parallel.

8. The burster of claim 5 wherein said stop members are relatively axially movable and carry meshable gear-like formations generally coaxial with said axis, means normally axially urging said gear-like formations into mesh with each other, means mounting said stop members for relative rotation, and means for effecting axial relative movement of said stop members against said urging means to disengage said gear-like formation to allow said relative rotation so that the relative position of said stops may be selectively varied.

9. The burster of claim 8 wherein said urging means comprises a compression coil spring surrounding said shaft and engaging said stop members.

10. The burster of claim 5 wherein at least said stops are plastic and integrally formed on their respective stop members.

* * * * *